US011851838B2

(12) United States Patent
Belland

(10) Patent No.: US 11,851,838 B2
(45) Date of Patent: Dec. 26, 2023

(54) APPARATUS TO AID IN MITIGATION OF RADON AND OTHER SOIL GASES

(71) Applicant: Lawrence Belland, Lake Oswego, OR (US)

(72) Inventor: Lawrence Belland, Lake Oswego, OR (US)

( * ) Notice: Subject to any disclaimer, the term of this patent is extended or adjusted under 35 U.S.C. 154(b) by 0 days.

(21) Appl. No.: 18/107,123

(22) Filed: Feb. 8, 2023

(65) Prior Publication Data

US 2023/0193581 A1 Jun. 22, 2023

Related U.S. Application Data

(60) Provisional application No. 63/405,427, filed on Sep. 10, 2022.

(51) Int. Cl.
*E02D 31/00* (2006.01)

(52) U.S. Cl.
CPC ..... *E02D 31/008* (2013.01)

(58) Field of Classification Search
CPC ..... E02D 31/008; Y10S 454/909; F24F 2110/68; F24F 8/70; B09C 1/005; E04C 2/324; E04C 2/326; E04C 2/38; E04C 2/40; E04C 2/405; E04C 2/42; E04B 2/8658; E04B 2/8635; E04B 2/8623; E04B 2/8629; E04B 2/845; E04B 2/8605
USPC ..... 454/909, 367
See application file for complete search history.

(56) References Cited

U.S. PATENT DOCUMENTS

| | | | | |
|---|---|---|---|---|
| 3,148,708 | A * | 9/1964 | Panella | F16L 55/115 220/378 |
| 4,957,394 | A * | 9/1990 | Jarnagin | E02D 31/008 405/229 |
| 5,403,119 | A * | 4/1995 | Hoyle | B09C 1/06 405/128.2 |
| 6,264,056 | B1 * | 7/2001 | King | E03C 1/28 220/4.24 |
| 6,524,182 | B2 * | 2/2003 | Kilburn | F24F 7/00 454/354 |
| 2008/0155929 | A1 * | 7/2008 | Herron | E04H 9/04 52/582.1 |
| 2011/0212680 | A1 * | 9/2011 | Schaefer | F24F 7/06 454/237 |
| 2015/0225114 | A1 * | 8/2015 | Sirowatka | B65D 9/06 217/13 |
| 2018/0305924 | A1 * | 10/2018 | Buffington | E04B 2/7405 |

* cited by examiner

*Primary Examiner* — Steven B McAllister
*Assistant Examiner* — Charles R Brawner

(57) ABSTRACT

Presented is an apparatus for radon and other soil gas mitigation. The apparatus includes an outer sleeve substantially cylindrical in shape and formed using one or multiple modular structures having foldable flaps with openings. The apparatus further includes a lid for closure of a top opening of the outer sleeve. The lid includes pipe flange(s) configured thereon for allowing a suction pipe to connect at its one end. During operation, other end of the suction pipe is operationally connected to operating inline fan which when operated exerts maximum negative pressure on the surrounding soil to entrain various soil gases that needs to be drawn out of the soil gas prone site (Eg. building).

18 Claims, 8 Drawing Sheets

APPARATUS TO AID IN MITIGATION OF RADON AND OTHER SOIL GASES

CROSS-REFERENCE TO RELATED APPLICATIONS

The present application hereby claims priority to and incorporates by reference the entirety of the disclosures of the provisional application No. 63/405,427 entitled "APPARATUS TO AID IN MITIGATION OF RADON AND OTHER SOIL GASES" filed on Sep. 10, 2022.

FIELD OF INVENTION

The present invention generally relates to the mitigation of radon and other soil gases, more specifically, the present invention relates to an apparatus or a device that would aid in the mitigation of radon and other soil gases (For example, methane, hydrocarbons, gases emanating from volatile organic compounds, water vapor, etc.) prevalent in the breathing zones of occupied buildings, water supply areas, and other similar sites.

BACKGROUND

Radon is a Class A carcinogen. It's a heavy radioactive and dangerous gas that can accumulate in our homes without our knowledge as radon cannot be seen, smelled, or tasted. Radon is the number one cause of lung cancer for non-smokers and the second-leading cause of lung cancer after smoking. Radon gas forms as a result of the decaying of Uranium in the soil. This radioactive gas is released from the soil and travels upward into the air. Radon becomes harmful when it enters a building and becomes trapped inside.

The Environmental Protection Agency (EPA) recommends considering mitigation of any building with a radon measurement between 2 pCi/l and 3.9 pCi/l and to absolutely abate radon if it's measured at 4.0 pCi/L or above. The World Health Organization (WHO) advises radon abatement if radon is measured at 2.7 pCi/1 or above. Every health organization in the world agrees that there is no safe level of radon. According to the U.S. Department of Health and Human Services, around 80 percent of American homes have not been tested for radon.

Radon is a dynamic event and radon levels may vary considerably at different sites, and over time at any given site. Because naturally occurring radon levels are known to cause health concerns, various testing products and methods have been introduced to aid in the detection of radon. One such radon detection product/method takes the form of a sealable package of radon adsorption material, most commonly activated charcoal. The package is situated in an area to be tested and opened so that the activated charcoal is exposed to ambient air for a measured testing period. At the end of the testing period, the package is sealed. The activated charcoal is later analysed to determine the level of radon, if any, adsorbed thereby. In this manner, a given test sites, such as a room or basement of a house or building, may be tested for the presence and/or level of radon therein. After the radon testing is performed to determine the level of radon, different radon mitigation methods are adopted to get rid of radon or at least bring down the radon level considerably below the EPA and WHO threshold levels. It has been seen that different professional radon mitigation contractors follow different radon mitigation methods to the best of their knowledge.

A basic radon mitigation technique widely practiced across the globe is simply to seal all discernible cracks and other openings in the building's foundation structure. This technique is considered "passive". Passive radon abatement is most often insufficient in preventing radon levels from exceeding the EPA and WHO action levels for abatement.

The most effective radon mitigation technique is called an "Active Soil Depressurization" (ASD) system. This requires a core in the slab of a house or a specific site location since the radon levels are higher at a lower level compared to other floors. The slab core is typically made 5-6" in diameter. Then 10-15 gallons of the material present below the slab is excavated through the core to form a suction point. A suction pipe is inserted and sealed into the suction point. The pipe may be sealed with polyurethane caulk or concrete to form a durable airtight seal. The other end of the suction pipe is connected to an inline fan that when operational, creates a negative pressure in the suction point which draws out the radon gas, and other soil gases, from beneath the slab.

When properties are found to have elevated radon levels that are built above the ground, with crawlspaces below the living area, the methods of abatement require either crawlspace encapsulation or subsoil abatement. Encapsulation requires the ground below the home to be covered with a plastic barrier, the edges are run up the foundation walls and sealed with butyl tape and anchored with concrete nails, the seams are overlapped by 12" and sealed with 4" waterproof vinyl tape, and all foundation piers are sealed around. A flexible perforated pipe is sealed under the barrier and run to the radon fan. Once the system is energized the air between the ground and the barrier is drawn out from under the home and vented above the rooftop. Encapsulation is very expensive. The alternative to encapsulation is a Sub-soil system. This entails digging a hole in the ground in the crawlspace, inserting a suction pipe into the middle of the hole, and then backfilling the hole with gravel or lava rock. The top of the hole, and around the suction pipe, are then covered with concrete to complete the seal. The suction pipe is run to the inline fan and when energized creates negative pressure below the soil to entrain radon and soil gases. Unfortunately, the gravel or lava rock used to backfill the hole, and support the suction pipe, eliminates up to 90% of the surface area available to apply the negative pressure to.

Although encapsulation is effective in reducing radon it is very expensive. Sub-soil systems are less expensive but provide inconsistent results. Consequently, many potential beneficiaries of radon mitigation systems continue to endure the harmful effects of radon, VOCs, and other soil gases.

Further, as required by different building codes, access openings to a crawl space through the floor/slab is usually a minimum of 18 inches by 24 inches. The crawl space openings through a perimeter wall will not be less than 16 inches by 24 inches. The size of the opening doesn't allow mitigating devices to be inserted into the crawlspace. Even if the user tries to adjust the size of the radon mitigating device to insert it inside the crawl space opening, it's difficult to maneuver the device inside the crawlspace, as some crawlspaces have less than 20" of headroom to work in.

In light of the foregoing, what is desired is an active soil gases mitigation technique that is simpler, inexpensive, highly effective, and provides consistent results when employed than currently known Sub-soil radon mitigation techniques. Thus, the inventor herein proposes a modular apparatus that would reduce the cost of soil gas mitigation, magnify the effectiveness of a soil gas system, and solves the problems stated above.

SUMMARY

Before the present systems and methods are described, it is to be understood that this application is not limited to the particular systems, and methodologies described, as there can be multiple possible embodiments that are not expressly illustrated in the present disclosures. It is also to be understood that the terminology used in the description is to describe the particular versions or embodiments only and is not intended to limit the scope of the present application.

It is the object of the present invention is to provide an apparatus to aid in the mitigation of radon and other soil gases such as methane from decomposing organic matter or landfills, hydrocarbons from underground fuel spills, pesticides that have been used around buildings, and other volatile organic compounds (VOCs), and water vapor.

It is another objective of the present invention to provide a modular device that may be used to create a durable subterranean cavity that will allow for maximum negative pressure to be exerted on the surrounding soil to entrain various soil gases such as radon gas.

Embodiments of the present invention disclose a modular apparatus adapted to aid in the mitigation of various soil gases. The apparatus adapted to aid in the mitigation of various soil gases comprising an outer sleeve with a top opening, and a bottom opening, wherein the outer sleeve is configured using at least one modular structure that comprises a plurality of flaps, each of the plurality of flaps being connected to one another and comprising a plurality of openings configured thereon; and a lid configured for closure of the top opening of the outer sleeve, wherein the lid comprising at least one pipe flange configured thereon for allowing a suction pipe to get connected thereto.

Various objects, features, aspects, and advantages of the present invention will become more apparent from the following detailed description of the embodiments of the invention, along with the accompanying drawings in which like numerals represent like components.

BRIEF DESCRIPTION OF THE DRAWINGS

The foregoing summary and the following detailed description of preferred embodiments are better understood when read in conjunction with the appended drawings. There is shown in the drawings example of embodiments, however, the application is not limited to the specific system and method disclosed in the drawings.

DETAILED DESCRIPTION

Some embodiments, illustrating its features, will now be discussed in detail. The words "comprising," "having," "containing," and "including," and other forms thereof, are intended to be equivalent in meaning and be open-ended in that an item or items following any one of these words is not meant to be an exhaustive listing of such item or items or meant to be limited to only the listed item or items. It must also be noted that as used herein and in the appended claims, the singular forms "a," "an," and "the" include plural references unless the context clearly dictates otherwise. Although any methods and systems similar or equivalent to those described herein can be used in the practice or testing of embodiments, the preferred methods, and systems are now described. The disclosed embodiments are merely exemplary.

The various features and exemplary embodiments of the present invention for a modular apparatus or device for the mitigation of radon and other similar soil gases will now be described in conjunction with the accompanying figures, namely FIGS. 1-10.

Referring to FIGS. 1-7, the device 100 for radon and similar soil gases mitigation includes an outer sleeve 102. The soil gases for the purpose of this application include but are not limited to radioactive gases and gases such as methane from decomposing organic matter or landfills, hydrocarbons from underground fuel spills, pesticides that have been used around buildings, and other volatile organic compounds (VOCs), water vapor.

The outer sleeve 102 according to an embodiment is made substantially cylindrical in shape. Typically, the outer sleeve 102 of the apparatus needs to be about 22 inches or 23 inches in diameter for satisfactory abatement of the radon and other similar harmful gases. In an embodiment, as shown, the outer sleeve 102 is formed using one or more modular structures 102*a*-102*d*. In a preferred embodiment presented in this disclosure, four such modular structures 102*a*-102*d* are shown interconnected to form the outer sleeve 102 of apparatus 100. However, it should be understood that the outer sleeve 102 may also be configured using a single modular structure or two such modular structures or even three such modular structures, or even more than 4 such modular structures, one just needs to customize the dimension and/or size of the modular structure being used for forming the outer sleeve 102.

Figure 3:
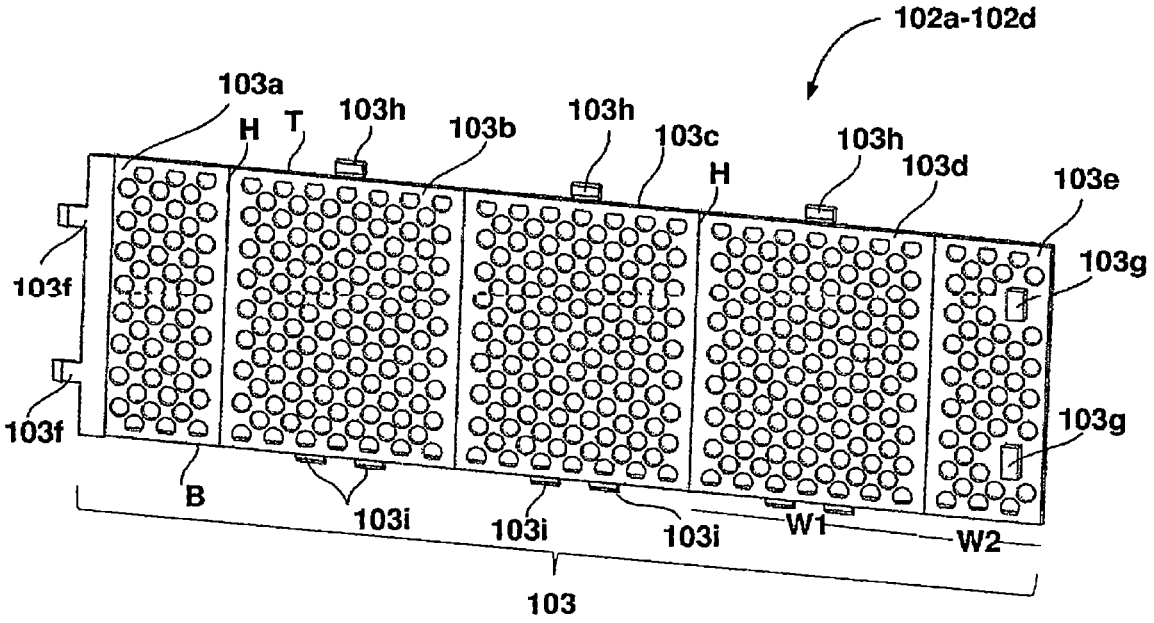
FIG. 3 shows a front perspective view of a single modular structure used to form an outer sleeve of the apparatus of FIG. 2.
Figure 4:
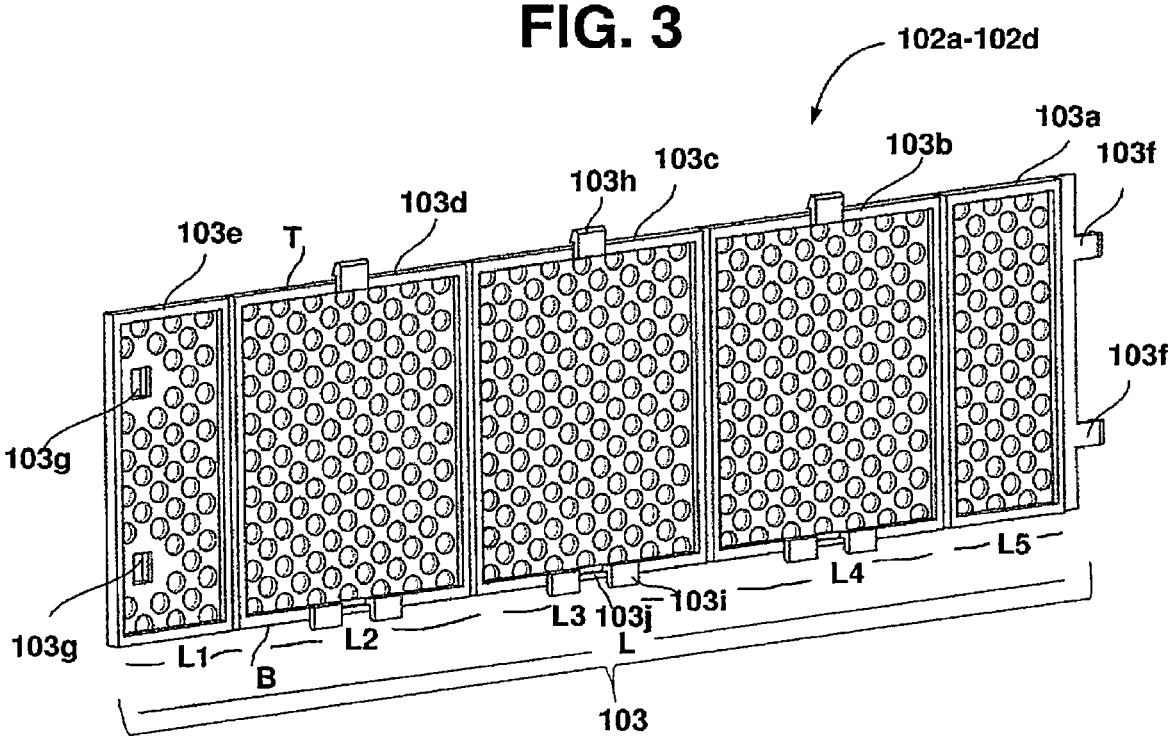
FIG. 4 shows a back perspective view of the modular structure of FIG. 3.

Each of the modular structures 102*a*-102*d*, as shown in FIGS. 3 and 4 include a plurality of flaps 103*a*-103*e* (hereinafter collectively referred to as 103). The flaps 103 are foldably attached to one another so that during the assembly of apparatus 100, the flaps 103 can be folded and the structures 102*a*-102*d* are interconnected to form the cylindrical-shaped outer sleeve 102. In an embodiment, each of the modular structures 102*a*-102*d* may be 11 inches in width and 50 inches in length (L). However, it should be understood that this dimension 11 inches×50 inches of the modular structure can be customized as per design requirements.

Figure 2:
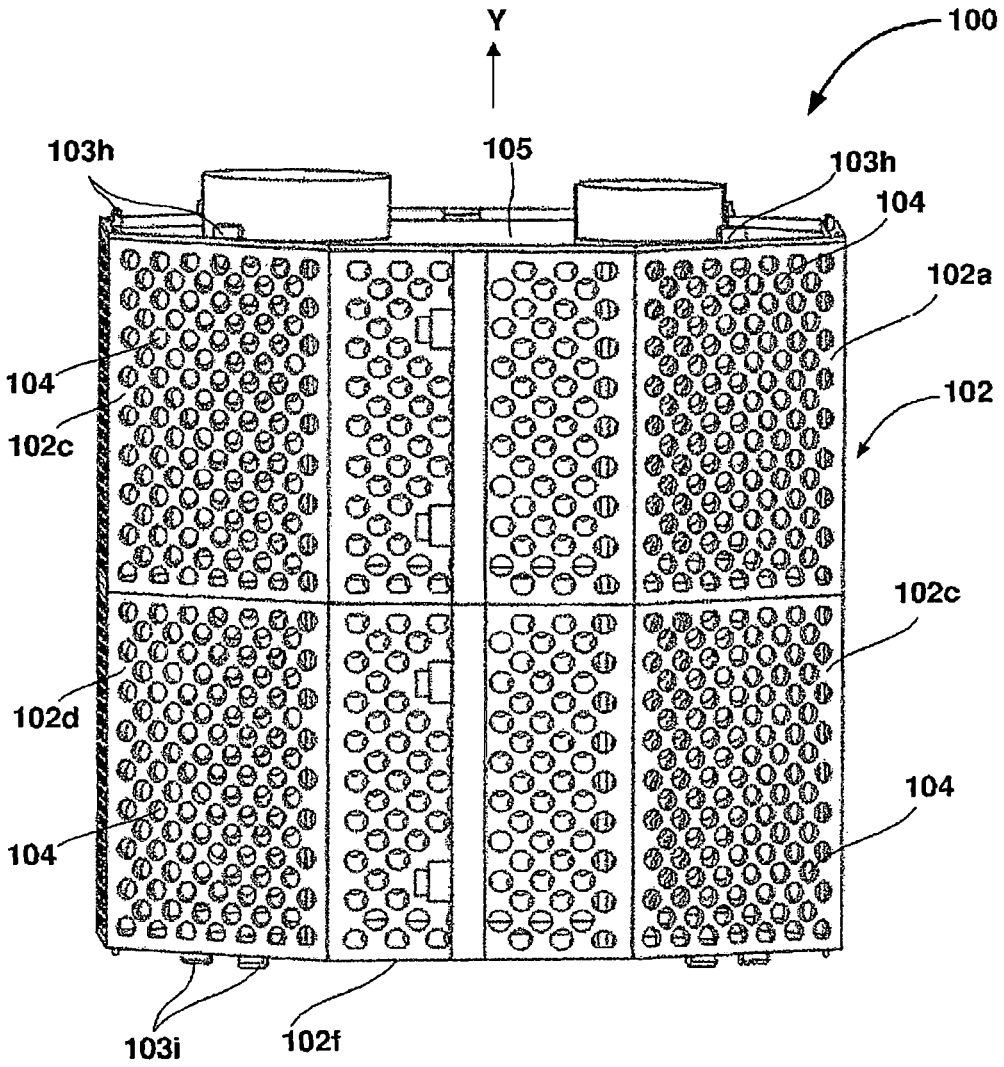
FIG. 2 illustrates a side view of the apparatus shown in FIG. 1 for the mitigation of radon and other soil gases in buildings or other site locations.
Figure 6:
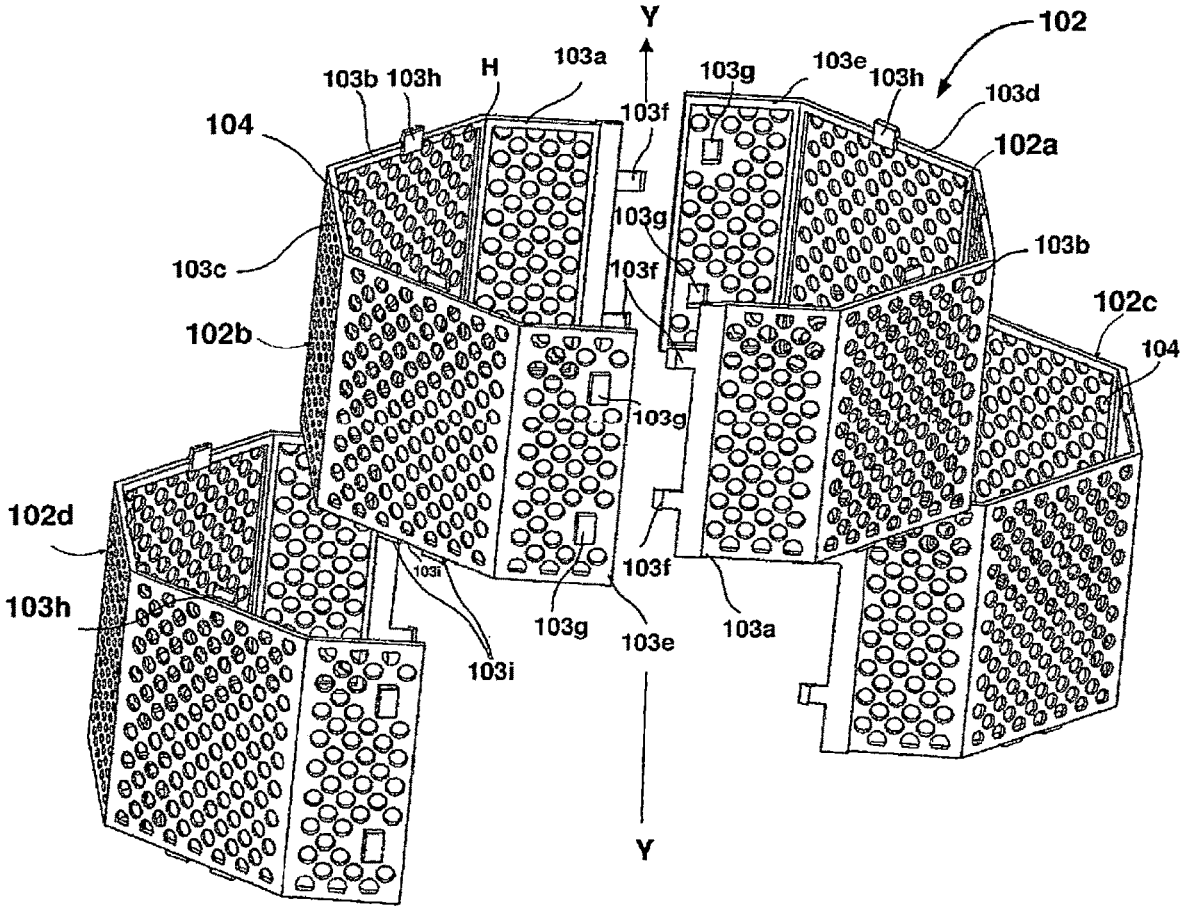
FIG. 6 illustrates an exploded view of the outer sleeve of the apparatus of FIG. 2.
Figure 7:
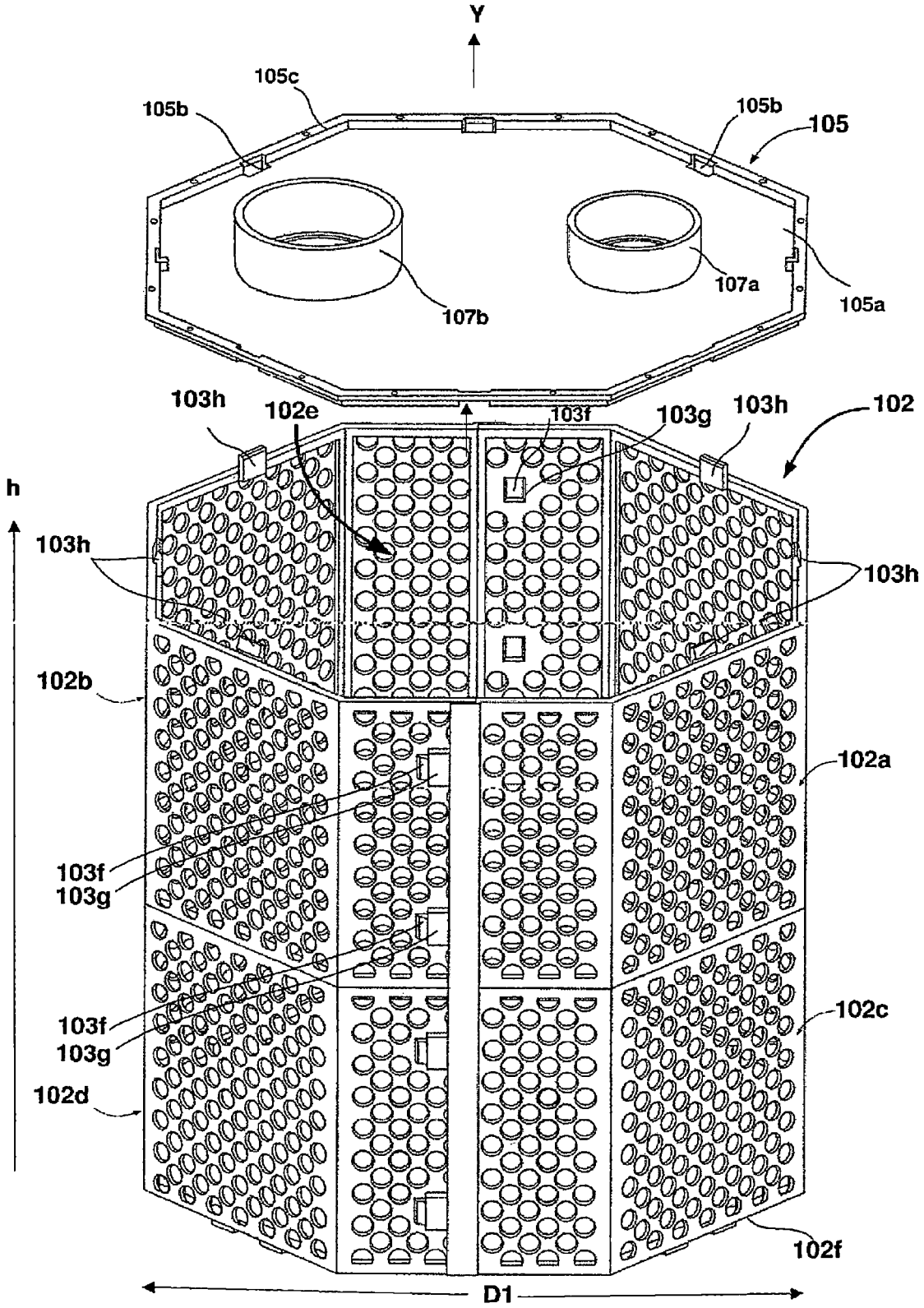
FIG. 7 illustrates an exploded view of the apparatus of FIG. 2.

As seen in FIGS. 3 and 4 along with FIGS. 2, 6, and 7, some of the flaps 103*a*-103*e* forming the modular structure 102*a*-102*d* may vary in size, typically widthwise. In a particular embodiment as shown, the flaps 103*b*-103*d* are shown in identical size (having width W1) whereas the extreme flaps 103*a* and 103*e* are represented in identical size (with width W2) and differ in width compared to the flaps 103*b*-103*d* by W1-W2. However, it should be understood that the number of flaps forming the modular structure 102*a*-102*d* can vary and also dimension of each of the flaps 103*b*-103*d* forming the modular structure 102*a*-102*d* can vary (they all can be identical in size or width, or some of the flaps might be identical and some may not (as in the current example) or all of those may vary in dimension in widthwise). As seen, each of the flaps 103*a*-103*e* is hingedly connected to the subsequent flap, for example, the flap 103*a* is hingedly connected to flap 103*b*, likewise, flap 103*b* is hingedly connected to the flap 103*c*, and so on. The hinged connection 'H' may be a living hinged connection or some suitable mechanical hinge connection. As would be understood by those skilled in the art, a living hinge is a thin section of material using which the flaps of the modular structure 102*a*-102*d* are formed. Additionally, as seen, the first extreme flap 103*a* of each of the modular structures 102*a*-102*d* comprises a plurality of locking tabs 103*f* configured at its one end extending outward while the flap 103*a* is hingedly connected to the flap 103*b* at its other end. Further, the second extreme flap 103*e* of each of the modular structures 102*a*-102*d* comprises a plurality of locking tab retainers 103*g* configured at its outer surface for receiving the plurality of locking tabs 103*f* of the extreme flap 103*a* of the same modular structure or other modular structures that interconnect to form the outer sleeve 102 of the apparatus 100.

Further, as seen in FIGS. 3, 4, 6, and 7, the intermediate flaps 103*b*-103*d* include at least one hook member 103*h* configured on a top end T of the intermediate flaps 103*b*-103*d*. In the given embodiment, although only one hook member 103 is shown configured on the top end T of the flaps 103*b*-103*d*, it should be understood that more than one such hook member may exist instead of just one as shown in the accompanying figures. Additionally, the intermediate flaps 103*b*-103*d* may further include a set of support members 103*i* (two or more than two) configured on a bottom end B of the intermediate flaps 103*b*-103*d*. During the assembly of the modular structures 102*a*-102*d* to form the outer sleeve 102, the hook member 103*h* would hook/engage onto an edge formation 103*j* formed at the bottom end B of the flaps 103*b*-103*d*. In an embodiment, the edge formation 103*j* is configured at the back/rear side of each of the modular structures 102*a*-102*d*. Specifically, the edge formation 103*j* is present at all sides or selected sides of the flaps 103*a*-103*e*. The edge formation 103*j* includes a predefined width to allow the hook member 103*h* to engage thereto. As seen, the edge formation 103*j* may run all along the length L of the modular structure or along the lengths L1-L5 of each of the flaps 103*a*-103*e* (FIG. 4). The set of supports members 103*i* of each of the intermediate flaps 103*b*-103*d* would support the engagement of one modular structure with the other modular structures (engagement due to hook member 103*h* with the edge formation 103*j*) when multiple modular structures are engaged along the Y axis to form outer sleeve 102 of desired height.

In an embodiment, the outer sleeve 102 may have a uniform diameter D1 throughout its height 'h' with a top opening 102*e* and a bottom opening 102*f*. The outer sleeve 102 may be made of other shapes too such as a cuboidal shape. The outer sleeve 102 may be made of plastic, an acrylonitrile butadiene styrene (ABS) material, or any other suitable material that may not degrade while coming in contact with the soil.

Figure 8:
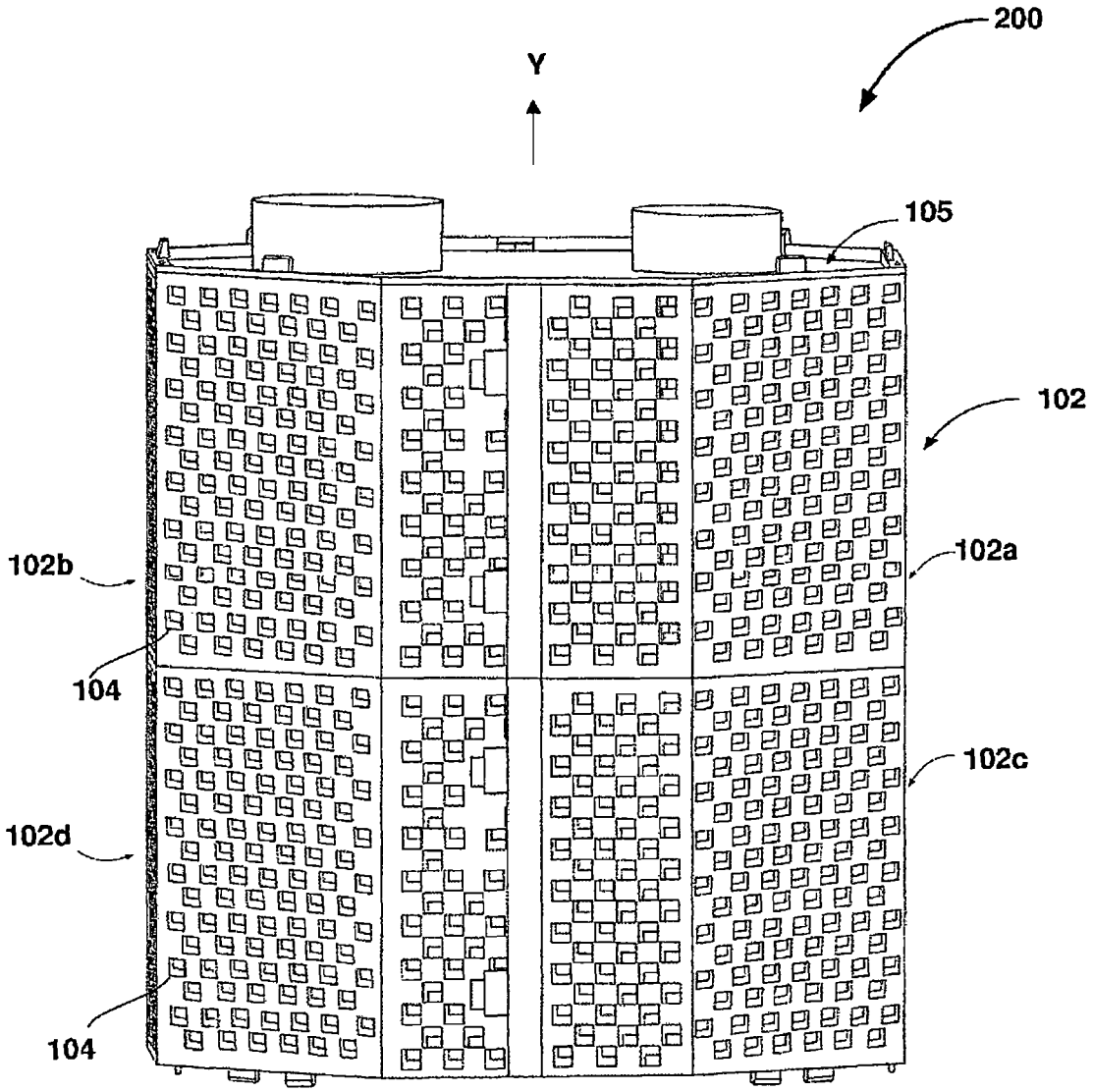
FIG. 8 illustrates a side view of the apparatus for the mitigation of radon and other soil gases in buildings or other site locations, according to another embodiment of the present invention.

The modular structures 102*a*-102*d* (specifically each of the flaps 103*a*-103*e*) forming the outer sleeve 102 include a plurality of openings 104. The openings 102*c* may be uniformly or non-uniformly distributed over the body of the flaps 103*a*-103*e* forming the modular structures 102*a*-102*d*. The openings 104 may be circularly shaped (as shown in FIGS. 1-7) or square-shaped (as shown in FIG. 8). In an embodiment, the openings 104 may be formed in ½-inch diameter or ⅝-inch diameter. However, it should be understood, the openings 104 may also be differently sized. Although the embodiments presented herein show the openings 104 in the circular form or square form, it should be understood that the openings 104 may be configured in any other shapes such as polygonal, oval, elongated rectangular shape and so on and even different combinations of shapes for the openings 104 may be used.

Figure 9:
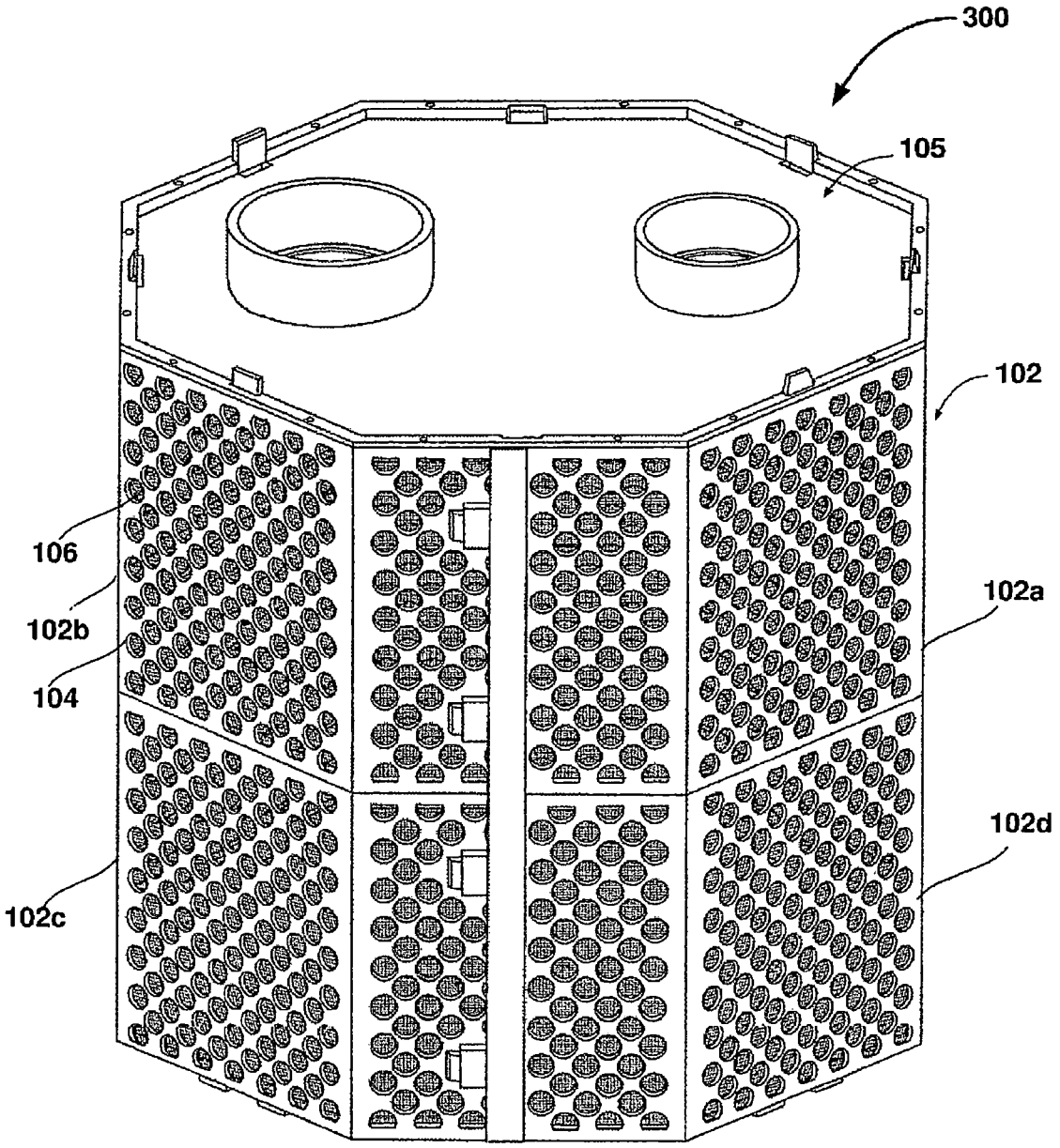
FIG. 9 illustrates a side view of the apparatus for the mitigation of radon and other soil gases in buildings or other site locations, according to yet another embodiment of the present invention.
Figure 10:
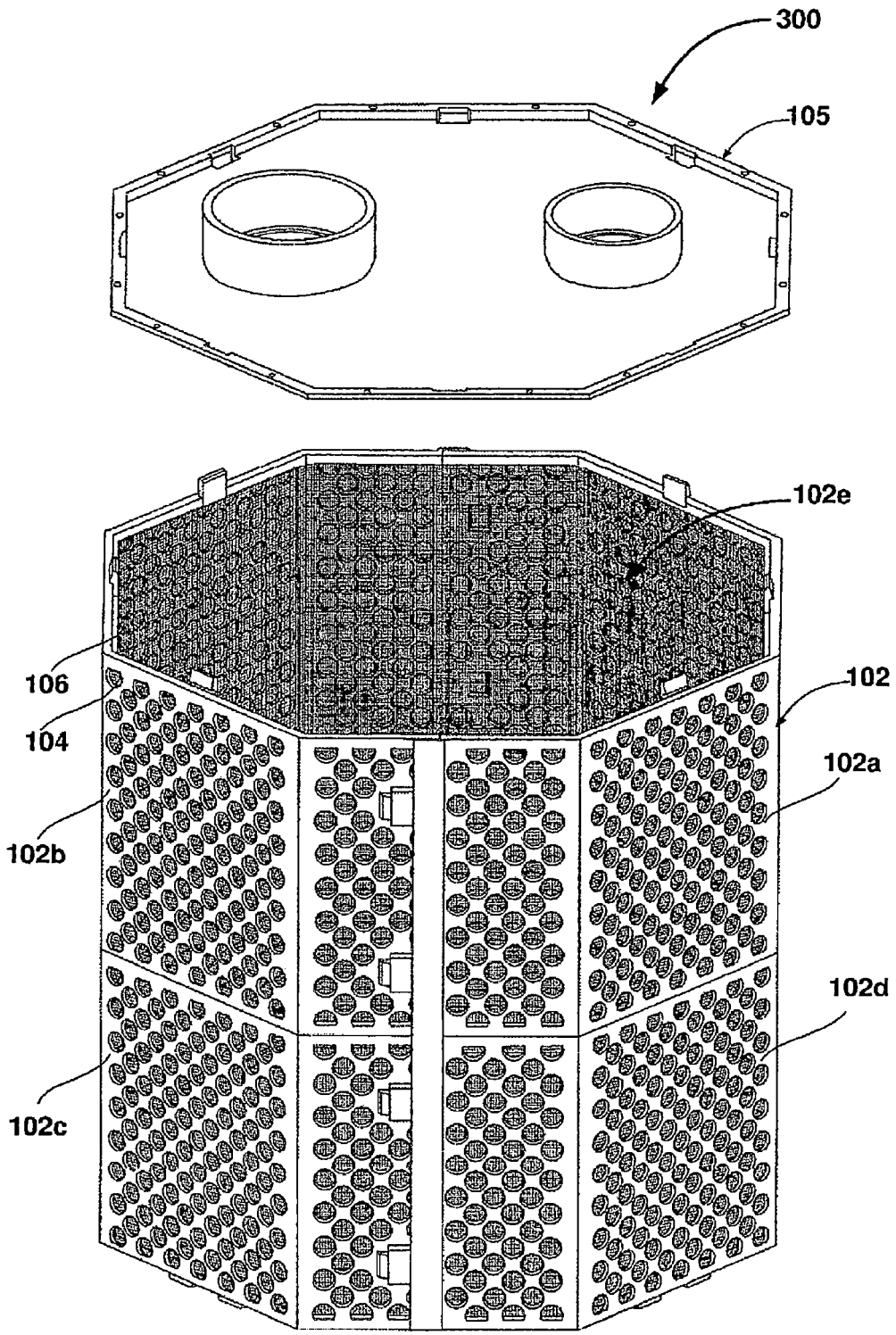
FIG. 10 illustrates an exploded view of the apparatus of FIG. 9.

According to some embodiment, as shown in FIGS. 9 and 10, the interior of the outer sleeve 102 may be covered by a wire mesh 106. The wire mesh 106 may be attached to the interior of the outer sleeve 102 using screws, other suitable fasteners, or adhesives. The wire mesh 106 may be about ¼×¼" or of some other suitable dimension. The purpose of the wire mesh 106 is to allow the soil gases such as radon to be drawn into the sleeve 102 and prevent soil or other debris from entering the inside the sleeve 102. The soil gases (indicated by arrows in FIG. 1) entering the interior of the sleeve 102 through the openings 104 is then exhausted out of the soil gases prone building or similar sites via a suction pipe 109 using an operating inline fan (not seen) connected to the suction pipe 109.

Figure 1:
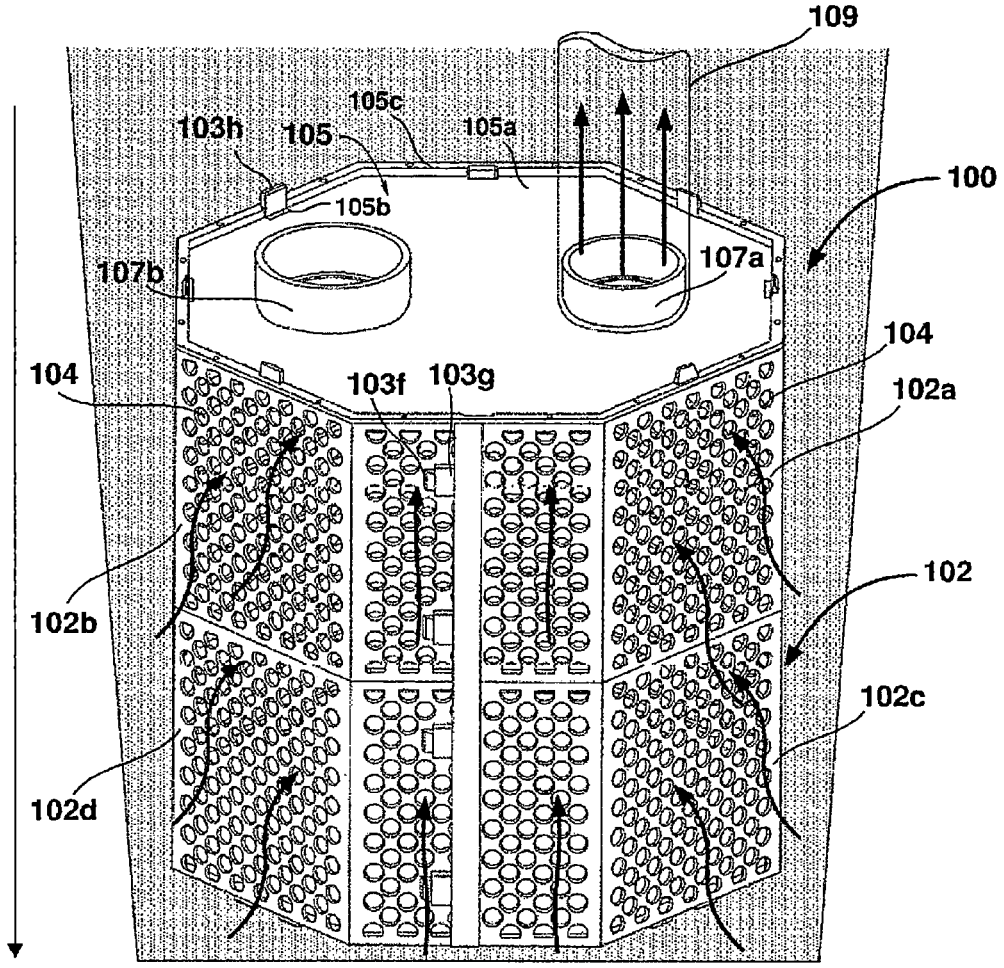
FIG. 1 illustrates an apparatus, in use, for the mitigation of radon and other soil gases in buildings or other site locations, according to an exemplary embodiment of the present invention.
Figure 5:
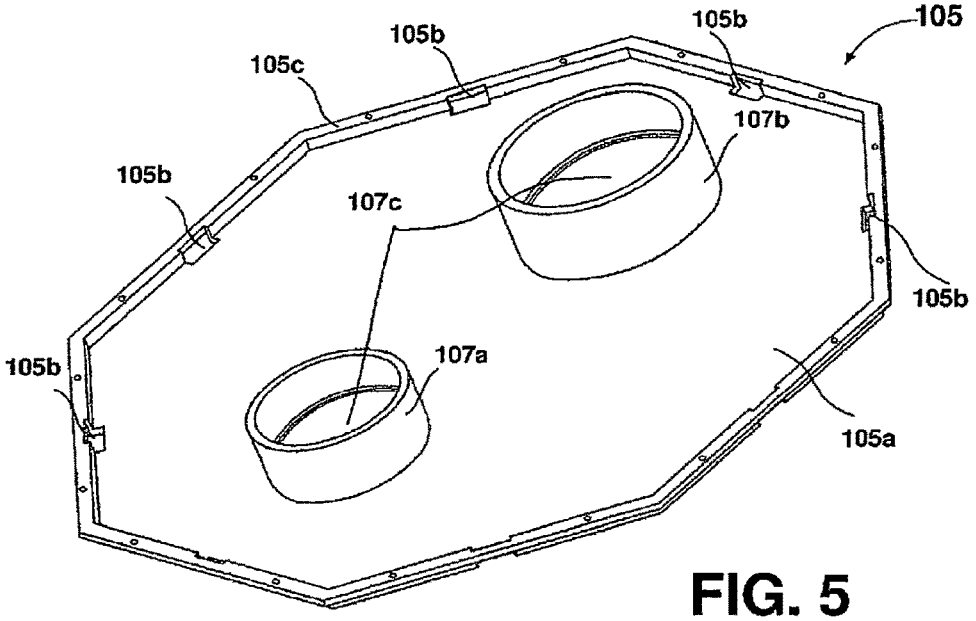
FIG. 5 shows a perspective view of a lid configurable on the outer sleeve of the apparatus of FIG. 2, according to an embodiment of the present invention.

The outer sleeve's 102 top opening 102*e* is covered by a lid 105. In an embodiment, the lid 105 may be fixedly configured on the outer sleeve 102 to cover the top opening 102*e*. In a preferred embodiment, the lid 105 may be removably configured on the outer sleeve 102 to cover the top opening 102*e*. As seen in FIGS. 1 and 7, the hook members 103*h* configured on the top end T of the intermediate flaps 103*b*-103*d* of the modular structures 102*a*-102*d* engage within a plurality of hook retaining slots 105*b* formed on the lid 105. As seen in FIG. 5, the lid 105 also includes upward extending wall 105 surrounding a top surface 105*a* of the lid 105. The lid 105 further comprises one or more pipe flanges 107*a*, 107*b* as shown in FIGS. 1 and 5. The pipe flanges 107*a*, and 107*b* may be made of standard dimensions based on the suction pipe 109 used throughout the industry. In an exemplary embodiment, the pipe flange 107*a* may be 3" in diameter whereas the pipe flange 107*b* may be 4" in diameter. In the embodiment shown herein, the lid 106 is shown to include two pipe flanges 107*a*, 107*b* of different dimensions (3" or 4") to facilitate the user to connect the suction pipe 109 to either of one for mitigating the soil gas therethrough once the inline fan is operational. However, it should be understood that the lid 105 may embody just one pipe flange 107*a* or 107*b* or pipe flange of any other dimensions. The pipe flanges 107*a*, 107*b* may be integrally formed on the top surface 105*a* of the lid 105, or the pipe flanges 107*a*, 107*b* may be removably attached on the lid 106. The suction pipe 109 is suitably sized to fit the pipe flanges 107*a*, 107*b* at one end. The other end of the suction pipe 109 usually has an operating inline fan (not seen) that would suck the soil gases out of the suction pipe 109.

According to an embodiment, an opening (not seen) of each of the pipe flanges 107*a*, 107*b* is initially sealed using a breakable seal 107*c*. The breakable seal 107*c* is formed as an integral part of the top surface 105*a* of the lid 105. In another embodiment, the apparatus 100 may include a cap (not seen) suitably sized to cover opening of the pipe flanges 107*a*, 107*b* instead of having the breakable seal 107*c* that you need to cut/break before connecting suction pipe 109 to the flanges 107*a* or 107*b* for drawing radon or other harmful gases out of the soil.

During the process of radon or other soil gas mitigation from a building (for example) having a basement area. The basement area usually comprises foundation walls and a basement slab. If the building is in an area where radon or soil gases are present, radon (or other soil gases) from the soil under and surrounding building may infiltrate into basement area and may subsequently accumulate to dangerous levels in the building, especially in the basement area. As a first step, after the detection of the presence of radon or other soil gases, a core cutting in the basement area of building or a specific site location is done using known processes. The slab core is typically made 5-6" in diameter. The material/soil present below the slab is then excavated through the core to form a hollow pit. The apparatus 100 in disassembled form or in the modular form is inserted into the hollow pit or crawlspace and then assembled thereinside such that the bottom opening 102*f* of the apparatus 100 comes in contact with the base of the hollow pit and the apparatus 100 is fully immersed into the pit. The entire apparatus 100 is buried under the ground including the top as seen in FIG. 1. There would be at least 6" of soil on top of the device 100. The breakable seal 107*c* covering the pipe flange 107*a* or 107*b* that needs to be used is broken. The other flange's breakable seal 107*c* is left unbroken. The flange 107*a* or 107*b* for which the breakable seal 107*c* is broken is connected to the suction pipe 109 at one end. The other end of the suction pipe 109 is then passed through the building and left outside the building. The other end of the suction pipe 109 also include an operational inline fan (not seen) which when operated allows for maximum negative pressure to be exerted on the surrounding soil to entrain various soil gases such as radon gas that would then pass out of the building through the suction pipe 109. When the inline fan is operated the solid gases tend to get drawn towards the outer sleeve 102 of the device 100 and enter into the outer sleeve 102 through the openings 104. Any undesired debris and soil particles are prevented to get into the sleeve 102 due to the low-profile bare openings 104 or the wire mesh 106 that acts as a barrier for these debris and soil particles.

It should be understood that the various components of the various embodiments of the apparatus 100 or 200 or 300 of the present invention are similar and interchangeable. It is obvious to the one skilled in the art that the various components of the 100 or 200 or 300 of one embodiment of the present invention could be considered for other embodiments with little or no variation. Further, the apparatus 100 and associated components thereof such as outer sleeve 102 formed using the modular structures 102*a*-102*d*, wire mesh b, lid 105, pipe flanges 107*a*,107*b*, etc. may be made using various materials and in many different dimensions. The material and dimensional variations of the apparatus 100 and associated components thereof should not be considered to be a limiting factor for the purpose of this disclosure.

It should be understood according to the preceding description of the present invention that the same is susceptible to changes, modifications, and adaptations and that the said changes, modifications and adaptations fall within scope of the appended claims.

What is claimed is:

1. An apparatus (100) adapted to aid in the mitigation of various soil gases, comprising:

an outer sleeve (102) with a top opening (102*e*), and a bottom opening (102*f*), wherein the outer sleeve (102) is configured using at least one modular structure (102*d*-102*d*) that comprises a plurality of flaps (103), each of the plurality of flaps (103) being hingedly connected to one another and comprising a plurality of openings (104) configured thereon;

a lid (105) configured for closure of the top opening (102*e*) of the outer sleeve (102), wherein the lid (105) comprising at least one pipe flange (107*a*, 107*b*) configured thereon for allowing a suction pipe (109) to get connected thereto;

Wherein, the at least one modular structure (102*a*-102*d*) comprising a plurality of intermediate flaps (103*b*-103*d*) of the plurality of flaps (103) having at least one hook member (103*h*) configured at a top end (T) thereof; and Wherein, the at least one hook member (103*h*) of one of the intermediate flaps (103*b*-103*d*) hooks onto an edge formation (103*i*) formed at a bottom end (B) of another the intermediate flaps (103*b*-103*d*) to assemble the one or more modular structures (102*a*-102*d*) together to form the outer sleeve (102).

2. The apparatus (100) of claim 1, wherein each of the plurality of flaps (103) are foldably attached to one another so that during the assembly of apparatus (100), the plurality of flaps (103) can be folded and the at least one modular structure (102*a*-102*d*) can be configured to form the outer sleeve (102) or can be interconnected with another modular structure (102*a*-102*d*) to form the outer sleeve (102).

3. The apparatus (100) of claim 1, wherein the at least one modular structure (102*a*-102*d*) comprising a first extreme flap (103*a*) having a plurality of locking tabs (103*f*) extending outward from an end of the first extreme flap (103*a*).

4. The apparatus (100) of claim 3, wherein the at least one modular structure (102*a*-102*d*) comprising a second extreme flap (103*e*) having a plurality of locking tab retainers (103*g*) configured at an outer surface for receiving the plurality of locking tabs (103*f*) of the extreme flap (103*a*) of the same or other modular structures (102*a*-102*d*) that interconnect to form the outer sleeve (102).

5. The apparatus (100) of claim 1, wherein the plurality of intermediate flaps (103*b*-103*d*) comprising a set of support members (103*i*) configured on the bottom end (B) of the intermediate flaps (103*b*-103*d*).

6. The apparatus (100) of claim 1, wherein the plurality of openings (104) are at least circular, rectangular, square, oval in shape.

7. The apparatus (100) of claim 1, wherein the lid (105) is removably configured for closure of the top opening (102*e*) of the outer sleeve (102).

8. The apparatus (100) of claim 1, wherein the at least one pipe flange (107*a*, 107*b*) is integrally formed on the lid (105).

9. The apparatus (100) of claim 1, wherein the suction pipe (109) is suitably sized to connect to the at least one pipe flange (107*a*, 107*b*) at one end and to an operating inline fan at its another end to allow for maximum negative pressure to be exerted on the surrounding soil to entrain various soil gases to be drawn out of the soil gas prone site.

10. The apparatus (100) of claim 1, wherein the outer sleeve (102) is cylindrical in shape.

11. The apparatus (100) of claim 1, wherein the plurality of openings (104) are uniformly distributed over the body of the plurality of flaps (103) forming the outer sleeve (102).

12. The apparatus (100) of claim 1, wherein each of the pipe flange (107*a*, 107*b*) includes an opening (not seen) sealed using a breakable seal (107*c*) formed as an integral part of the top surface (105*a*) of the lid (105).

13. The apparatus (100) of claim 1 further comprising a cap (not seen) suitably sized to cover opening of the pipe flange (107*a*, 107*b*) that needs removed before connecting suction pipe (109) to the pipe flange (107*a* or 107*b*) for drawing radon or other harmful gases out of the soil.

14. The apparatus (100) of claim 1 further comprising a wire mesh (106) attached to interior of the outer sleeve (102) covering the plurality of openings (104), wherein the wire mesh (106) allows the soil gases to be drawn into the outer sleeve (102) and prevent soil or other debris from entering the outer sleeve (102).

15. The apparatus (100) of claim 1, wherein the lid (105) is fixedly configured for closure of the top opening (102*e*) of the outer sleeve (102).

16. The apparatus (100) of claim 1, wherein the at least one pipe flange (107*a*, 107*b*) is removably attached on a top surface (105) of the lid (105).

17. The apparatus (100) of claim 1, wherein the plurality of openings (104) are non-uniformly distributed over the body of the plurality of flaps (103) forming the outer sleeve (102).

18. An apparatus (100) adapted to aid in the mitigation of various soil gases, comprising:

an outer sleeve (102) with a top opening (102*e*), and a bottom opening (102*f*), wherein the outer sleeve (102) is configured using at least one modular structure (102*d*-102*d*) that comprises a plurality of flaps (103), each of the plurality of flaps (103) being hingedly connected to one another and comprising a plurality of openings (104) configured thereon;

a lid (105) configured for closure of the top opening (102*e*) of the outer sleeve (102), wherein the lid (105) comprising at least one pipe flange (107*a*, 107*b*) configured thereon for allowing a suction pipe (109) to get connected thereto;

a wire mesh (106) attached to interior of the outer sleeve (102) covering the plurality of openings (104), wherein the wire mesh (106) allows the soil gases to be drawn into the outer sleeve (102) and prevent soil or other debris from entering the outer sleeve (102);

Wherein, the at least one modular structure (102*a*-102*d*) comprising a plurality of intermediate flaps (103*b*-103*d*) of the plurality of flaps (103) having at least one hook member (103*h*) configured at a top end (T) thereof; and Wherein, the at least one hook member (103*h*) of one of the intermediate flaps (103*b*-103*d*) hooks onto an edge formation (103*j*) formed at a bottom end (B) of another the intermediate flaps (103*b*-103*d*) to assemble the one or more modular structures (102*a*-102*d*) together to form the outer sleeve (102).

* * * * *